US005229537A

United States Patent [19]

Kennedy

[11] Patent Number: 5,229,537

[45] Date of Patent: Jul. 20, 1993

[54] ELECTRIC FIDDLE AND PICKUP

[76] Inventor: Clifford E. Kennedy, 218 Ruby St., Boise, Id. 83705

[21] Appl. No.: 806,159

[22] Filed: Dec. 12, 1991

[51] Int. Cl.[5] ..... G10H 3/14

[52] U.S. Cl. ..... 84/727

[58] Field of Search ..... 84/726-727, 84/743

[56] References Cited

U.S. PATENT DOCUMENTS

| | | | |
|---|---|---|---|
| 2,978,945 | 4/1961 | Dopera | 84/727 |
| 4,050,341 | 9/1977 | Underwood . | |
| 4,069,732 | 1/1978 | Moskowitz et al. . | |
| 4,184,398 | 1/1980 | Sigelman . | |
| 4,235,143 | 11/1980 | Hoexter | 84/727 |
| 4,236,433 | 12/1980 | Holland . | |
| 4,372,186 | 2/1983 | Aaroe . | |
| 4,501,186 | 2/1985 | Ikuma . | |
| 4,524,667 | 6/1985 | Duncan . | |
| 4,535,668 | 8/1985 | Schaller . | |
| 4,567,805 | 2/1986 | Clevinger | 84/DIG. 24 X |
| 4,581,974 | 4/1986 | Fender . | |
| 4,612,840 | 9/1986 | Gretsch et al. . | |
| 4,686,881 | 8/1987 | Fender . | |
| 4,727,634 | 3/1988 | Fishman . | |
| 4,750,400 | 6/1988 | Milne . | |
| 4,765,219 | 8/1988 | Alm . | |
| 4,809,578 | 3/1989 | Lace, Jr. . | |
| 4,878,412 | 11/1989 | Resnick . | |
| 4,919,033 | 4/1990 | Markov et al. . | |
| 4,941,389 | 1/1990 | Wendler . | |
| 5,027,691 | 7/1991 | Kennedy | 84/727 |
| 5,031,501 | 7/1991 | Ashworth | 84/743 |

*Primary Examiner*—William M. Shoop, Jr.
*Assistant Examiner*—Jeffrey W. Donels
*Attorney, Agent, or Firm*—Frank J. Dykas; Craig M. Korfanta; Ken J. Pedersen

[57] ABSTRACT

The invention is an electric pickup for stringed instruments comprising an isolated bridge and a hollow coil suspendedly held beneath the strings. A fixed, adjustable member suspendedly holds a magnet within the hollow center of the coil, or suspendedly holds the coil with its hollow center around a magnet. Also, the invention is an improved electric fiddle stick employing this electric pickup.

7 Claims, 4 Drawing Sheets

ELECTRIC FIDDLE AND PICKUP

BACKGROUND OF THE INVENTION

1. Technical Field

This invention relates to stringed musical instruments with electric pickups. More particularly, this invention relates to an electric fiddle and a special electric pickup.

2. Related Art

In my U.S. Pat. No. 5,027,691 (Kennedy), I disclose an electric fiddle stick with metallic strings and a pickup comprising a magnet and a coil suspendedly attached towards the neck of the instrument under the fingerboard. In this patent I refer to electromagnetic pickups in general as described by U.S. Pat. Nos. 4,069,732 (Moskowitz, et al.), 4,184,398 (Sigelman), 4,236,433 (Holland), 4,535,668 (Schaller), and 4,581,974 (Fender), and 4,765,219 (Alm).

DISCLOSURE OF INVENTION

What I have invented is:

An electric pickup for a stringed instrument comprising:

(a) a bridge in isolated engagement with the body of the instrument at the bridge's bottom end, said bridge being in tensioned engagement with the strings of the instrument at the bridge's top end;

(b) an electric coil with a hollow center held in suspended relationship beneath said strings, said coil being electrically connected to amplification means;

(c) a magnet held in suspended relationship within said hollow center of said coil; and, (d) a moveable, adjustable member, in fixed engagement with said body of the instrument, said adjustable member maintaining the suspended relationship between said hollow center of said coil and said magnet.

My electric pickup above includes the feature wherein the coil is fastened to the bridge and the magnet is held within the hollow center of said coil by the moveable, adjustable member. Also, my electric pickup includes the feature wherein the magnet is fastened to the bridge and the coil is held with its hollow center around the magnet by the moveable, adjustable member.

Also, what I have invented is:

An improved electric fiddle stick comprising:

(a) an elongated body including a head, a neck, a fingerboard, a base section and a butt;

(b) a plurality of strings fastened on their first end to said head and on their second end to said butt, said strings being in close, parallel relationship to the top surface of said fingerboard;

(c) a bridge in isolated engagement with said base section at the bridge's bottom end, said bridge being in tensioned engagement with said plurality of strings at the bridge's top end;

(d) an electric coil with a hollow center held in suspended relationship beneath said strings, said coil being electrically connected to amplification means;

(e) a magnet held in suspended relationship within said hollow center of said coil;

(f) a moveable, adjustable member, in fixed engagement with said base section, said adjustable member maintaining the suspended relationship between said hollow center of said coil and said magnet.

My improved fiddle stick above includes the features wherein the strings are metallic, non-metallic or a combination of the two.

By using my invention, an improved electric fiddle stick is provided which amplifies a true, clear fiddle tone.

BEST MODE FOR CARRYING OUT INVENTION

Figure 1:
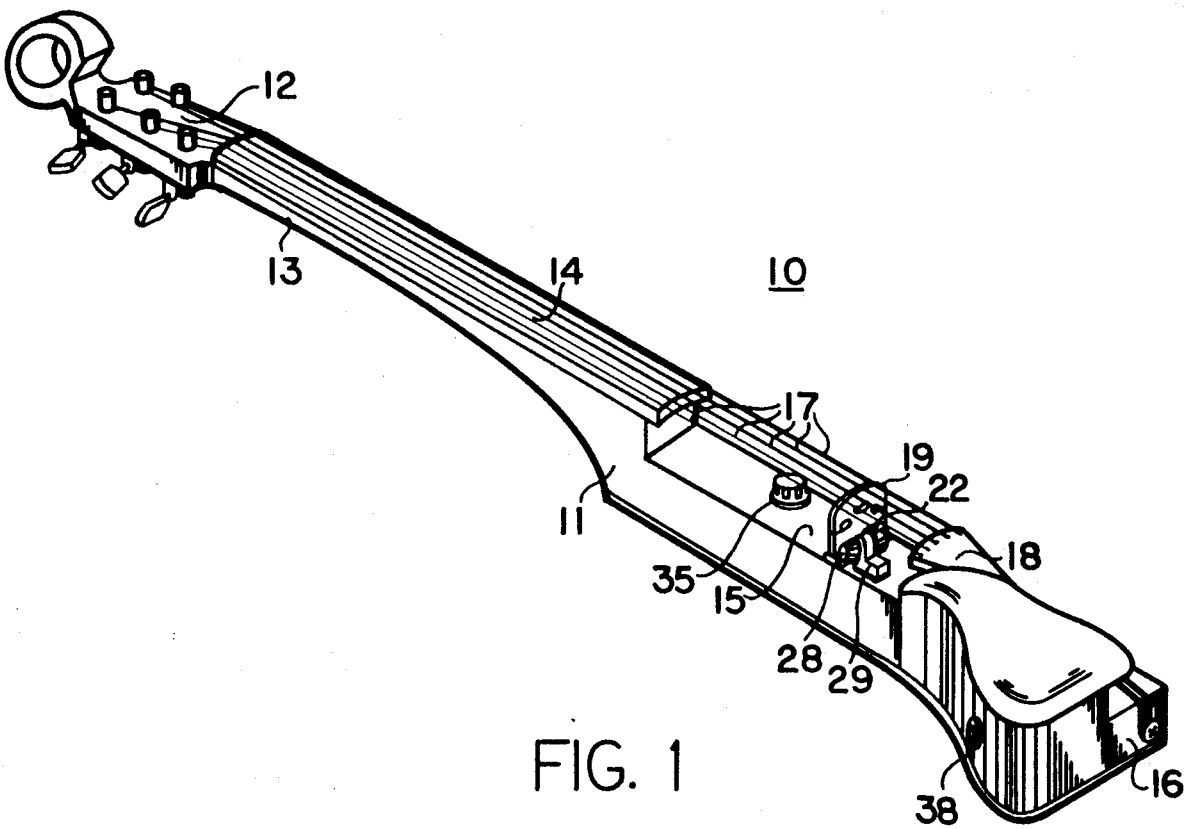
FIG. 1 is a perspective view of one embodiment of my improved fiddle stick.
Figure 2:
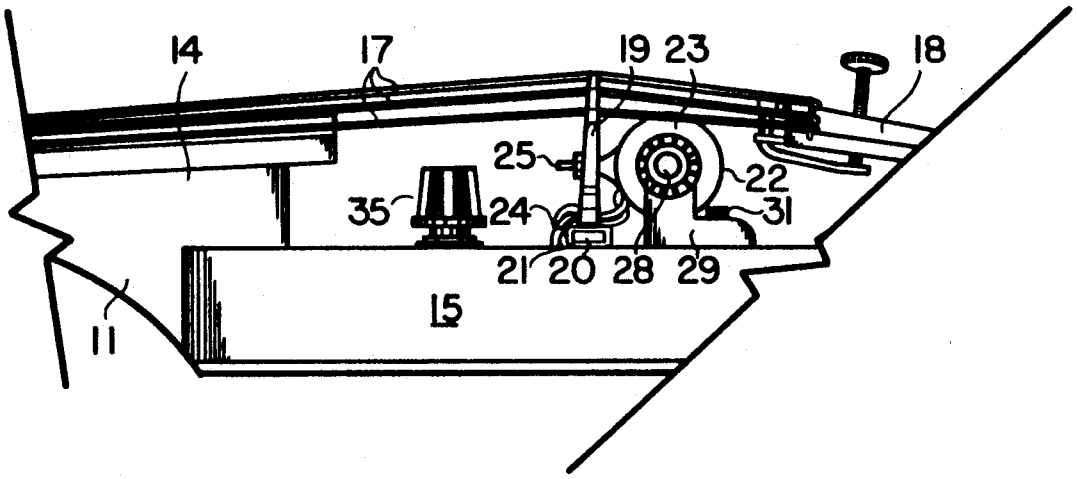
FIG. 2 is a left-side, partial view of the bridge and pickup section of one embodiment of my improved fiddle stick.
Figure 3:
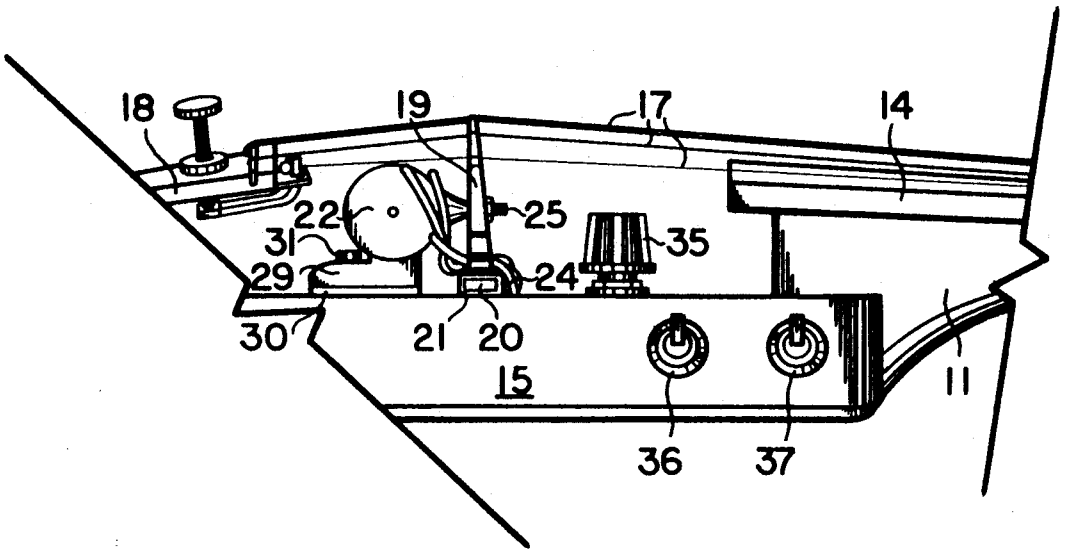
FIG. 3 is a right-side, partial view of the bridge and pickup section of one embodiment of my improved fiddle stick.
Figure 4:
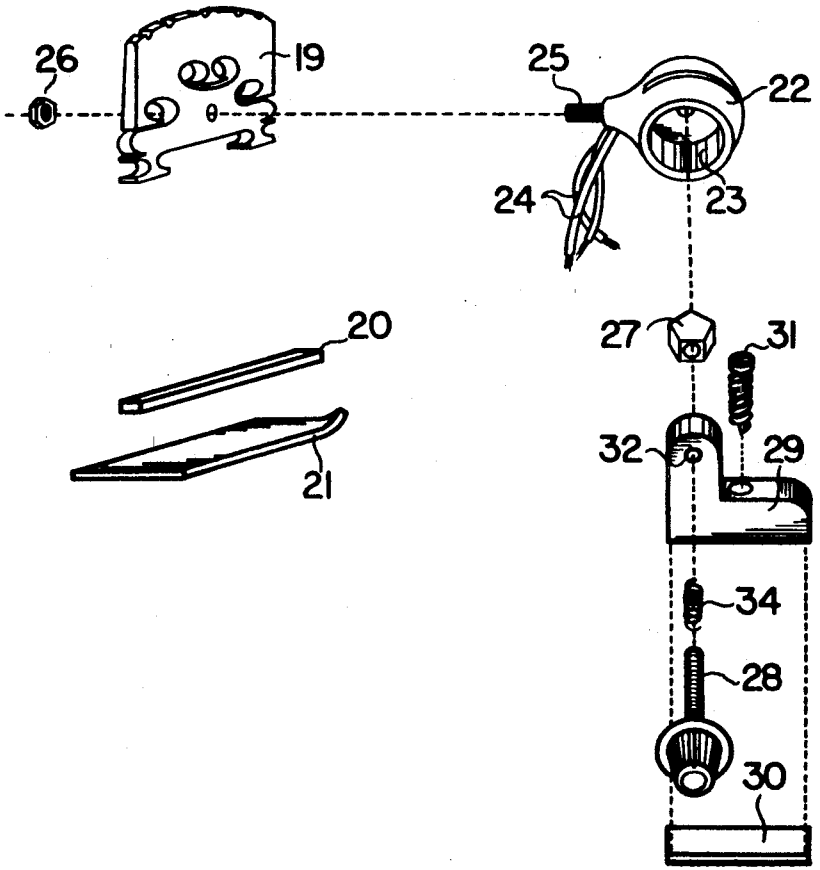
FIG. 4 is an exploded, partial view of the bridge and pickup section of one embodiment of my improved fiddle stick.

Referring to the FIGURES, there is depicted generally my improved fiddle stick 10 with an elongated body 11 including head 12, neck 13, fingerboard 14, base section 15 and butt 16. A plurality of strings 17 are fastened on their first end to the head 12, and on their second end to butt 16 via tail piece 18. The strings are in close, parallel relationship to the top surface of said fingerboard, so they may be depressed and held against it by the player.

Bridge 19 is in isolated engagement with base section 15 at bridge's 19 bottom end. Bridge base 20 is wrapped in, or otherwise surrounded by, bridge pad 21, to support bridge 19 on, and to isolate it from, base section 15. Bridge 19 is in tensioned engagement with strings 17 at bridge's 19 top end. Strings 17, fastened tightly on one end to head 12, and on the other end to tail piece 18 and butt 16, press down on the top of bridge 19 and hold it firmly against base section 15.

Electric coil 22 has a hollow center section 23 and electrical wires 24 which connect it to conventional amplification means. In the embodiment shown, coil 22 is securely fastened to bridge 19 via bolt 25 and nut 26. In this embodiment, bridge 19 holds coil 22 in suspended relationship beneath strings 17 between bridge 19 and tail piece 18.

Also in this embodiment, magnet 27 is connected to threaded rod 28, and held in suspended relationship by rod 28 within hollow center 23 of coil 22. Rod 28 is a moveable, adjustable member held in fixed engagement with base section 15 by rod support 29 and rod support pad 30 which are fastened to base section 15 by screw 31. Threaded hole 32 in rod support 29 permits rod 28 to be turned, and moved in and out, relative to coil's 22 hollow center section 23. Consequently, magnet 27 may also be turned, and moved in and out, relative to hollow center section 23.

In another embodiment not shown in the drawings, magnet 27 may be securely fastened to bridge 19 and coil 22 connected to threaded rod 28. Also, the magnet and the coil may be held in suspended relationship beneath strings 17 between fingerboard 14 and bridge 19. All that I require for my pickup is the magnet 27 suspended in the hollow center 23 of the coil 22, beneath the strings 17 and one of the magnet and coil vibrating relative to the other. I prefer the embodiment depicted in the drawings, however.

My improved fiddle stick is made from conventional materials by conventional techniques. Preferably, elongated body 11, head 12, neck 13, fingerboard 14, base section 15 and butt 16 are made of wood. A convenient chin rest 33, also made of wood, may be provided on the top side of butt 16. Metallic strings 17 may be spirally wrapped, flat wires or solid, cylindrical wire strands, as in ordinary metallic stringed instruments. Non-metallic strings may be solid, cylindrical nylon strands, for example.

Bridge 19 is also made of wood, and shaped like ordinary bridges for stringed instruments. Bridge base 20 is made of plastic, preferably ultra-high molecular weight polyethylene. Bridge pad 21 is preferably made of a soft, sticky, latex or rubber material, which provides maximum dampening effect from base section 15 to bridge 19, and maximum gripping effect, between the bridge 19 and the base section 15. A good bridge pad 21 is simply a short section of surgical tubing slid around bridge base 20.

Electric coil 22 is constructed by wrapping an insulated wire winding about a cylindrical form, for example, and then removing the form to create a hollow center section 23. There may be one or more discreet wire windings, or one or more coils with a common hollow center 23. The coils may be wrapped with different size wire windings, or with a different number of wraps, to produce different levels of amplification, and different tones. Generally, the wires are wrapped in the same direction to give the coil a specific electrical sense.

Magnet 27 may be metal or ceramic, and it may be of various shapes so that the magnetic poles may be in any direction. A unique feature of my invention is that the magnet is nearly universally adjustable within hollow center section 23 of coil 22. This way, the tone picked up by the coil and magnet combination may also be nearly universally adjusted. The strength of the indigenous magnetic field in magnet 27 may vary. In fact, it may be very slight or even zero. I have been able to make my pickup work with a plain piece of metal used as magnet 27. However, I think this is possible because the coil tends to magnetize the metal piece suspended within the coil's hollow center.

Preferably, rod 28 is a threaded rod which cooperates with threaded hole 32 in rod support 29. Optionally, there may be a spiral spring 34 wrapped around rod 28 to securely hold it at its desired adjustment. Rod support 29 is also made of plastic, preferably ultra-high molecular weight polyethylene. Rod support pad 30 is also made of a firm, hard plastic, but preferably of a material different than that of rod support 29 in order to prevent resonance and to maximize direct vibrational contact with base section 15.

In use, my instrument may be bowed or plucked in much the same manner as a fiddle or violin. When the strings 17 are bowed or plucked they vibrate, causing the bridge 19, and connected coil 22 to vibrate also. Consequently, coil 22 vibrates with respect to the relatively fixed magnetic field of magnet 27 suspended within the hollow center section 23 of coil 22, and electrical lines 24 transmit the resulting change in emf in the coil to conventional amplification means. Control switch knobs 35, 36 and 37 may be positioned on the elongated body 11 as desired, and electrically or electronically configured as desired to adjust volume and tone according to conventional techniques. Output jack 38 is provided for an easy electrical connection to amplification means.

While there is shown and described the present preferred embodiment of the invention, it is to be distinctly understood that this invention is not limited thereto but may be variously embodied to practice within the scope of the following claims.

What I claim is:

1. An electric pickup for a stringed instrument comprising:

(a) a bridge in isolated engagement with the body of the instrument at the bridge's bottom end, said bridge being in tensioned engagement with the strings of the instrument at the bridge's top end;

(b) an electric coil with a hollow center held in suspended relationship beneath the strings, said coil being electrically connected to amplification means;

(c) a magnet held in suspended relationship within said hollow center of said coil; and, (d) a moveable, adjustable member, in fixed engagement with said body of the instrument, said adjustable member maintaining the suspended relationship between said hollow center of said coil and said magnet.

2. The pickup of claim 1 wherein the coil is fastened to the bridge and the magnet is held within the hollow center of said coil by the moveable, adjustable member.

3. The pickup of claim 1 wherein the magnet is fastened to the bridge and the coil is held with its hollow center around the magnet by the movable adjustable member.

4. The improved fiddle stick of claim 1 wherein the strings are metallic strings.

5. The improved fiddle stick of claim 1 wherein the strings are non-metallic strings.

6. The improved fiddle stick of claim 1 wherein the strings are a combination of metallic and non-metallic strings.

7. An improved electric fiddle stick comprising:

(a) an elongated body including a head, a neck, a fingerboard, a base section and a butt;

(b) a plurality of strings fastened on their first end to said head and on their second end to said butt, said strings being in close, parallel relationship to the top surface of said fingerboard;

(c) a bridge in isolated engagement with said base section at the bridge's bottom end, said bridge being in tensioned engagement with said plurality of strings at the bridge's top end;

(d) an electric coil with a hollow center held in suspended relationship beneath said strings, said coil being electrically connected to amplification means;

(e) a magnet held in suspended relationship within said hollow center of said coil;

(f) a moveable, adjustable member, in fixed engagement with said base section, said adjustable member maintaining the suspended relationship between said hollow center of said coil and said magnet.

* * * * *